United States Patent [19]

Imanishi et al.

[11] Patent Number: 4,800,777

[45] Date of Patent: Jan. 31, 1989

[54] DYNAMIC BALANCING DEVICE FOR PRESS

[75] Inventors: Shozo Imanishi; Mitsuo Sato, both of Sagamihara, Japan

[73] Assignee: Aida Engineering, Ltd., Kanagawa, Japan

[21] Appl. No.: 774,363

[22] Filed: Sep. 10, 1985

[51] Int. Cl.[4] ..... B30B 5/00

[52] U.S. Cl. ..... 74/604; 74/590

[58] Field of Search ..... 74/589, 590, 591, 603, 74/604; 100/282; 123/192 B, 192 R; 83/615, 632

[56] References Cited

U.S. PATENT DOCUMENTS

| | | | |
|---|---|---|---|
| 3,422,688 | 1/1969 | Bruderer | 74/590 |
| 3,528,319 | 9/1970 | Ishida | 74/604 |
| 3,695,090 | 10/1972 | Kita | 100/282 |
| 3,772,986 | 11/1973 | Kawagoshi et al. | 100/282 |
| 3,808,912 | 5/1974 | Voorhees et al. | 74/604 |
| 3,896,693 | 7/1975 | Johansson | 74/604 |
| 4,156,387 | 5/1979 | Portmann | 74/603 |
| 4,160,409 | 7/1979 | Portmann | 74/603 |
| 4,276,823 | 7/1981 | Rotzler | 100/282 |
| 4,376,410 | 3/1983 | Wissman et al. | 100/282 |
| 4,397,232 | 8/1983 | Schockman et al. | 100/282 |
| 4,603,573 | 8/1986 | Ganago et al. | 100/282 |
| 4,607,732 | 8/1986 | Ikeoka et al. | 100/282 |

*Primary Examiner*—Gary L. Smith

*Attorney, Agent, or Firm*—Wenderoth, Lind & Ponack

[57] ABSTRACT

A dynamic balancing device for a press is provided for balancing the inertia forces generated by the reciprocating parts of the press using balancing weights. A connecting rod is mounted around the crank of the drive shaft and has one end pivotally connected to the slide and the other end pivotally connected to a link. The link is connected to a pair of levers extending in opposite directions. The levers are used to move a respective pair of balancing weights 17 in opposite directions to the direction of movement of the reciprocating members of the press. The balancing weights are guided by guide pins 18 received in bores extending through the balancing weights.

3 Claims, 3 Drawing Sheets

DYNAMIC BALANCING DEVICE FOR PRESS

DETAILED DESCRIPTION OF THE INVENTION

This invention relates to a dynamic balancing device for a press.

In the prior art dynamic balance of inertia forces is maintained between a slide which moves up and down and a crank mechanism which rotates eccentrically within a press by providing balance weights which move relative to the crankshaft or the slide via gears, levers or links. But this inevitably makes the whole structure complex and large, presenting a difficulty.

In the prior art, an example of this type of balancing device is found in British Pat. No. 1,502,193 or U.S. Pat. No. 4,160,409 in which the dynamic balance of inertia forces is maintained between a slide which moves up and down and a crank mechanism which rotates eccentrically inside a press.

The structure of the above patent was defective in that the mechanism was inevitably complex in order to cope with stroke changes of the slide. More particularly, the variable mechanism for the slide stroke was incorporated in the press housing (the press crown), and the balance weight was made movable in the horizontal direction. The weight is therefore connected and supported only by the links. In this structure, the weight is not guided securely and the movement becomes instable.

Other conventional devices have links and many fulcrums to connect the links, all the fulcrums having slight clearances which deteriorates the performance of the balancing device and shortens the durable life of the machine.

In this invention, an eccentric bush for actuating the balance weight is provided at the end of a link which is connected with the connecting rod instead of the crank shaft. The balance at the rotating portion is kept by the balancing weights provided on the drive shaft while the balance at the slide is kept by the balancing weights connected to said link. This resulted in simplifying the whole mechanism and reducing the size of the balancing device.

The balancing weight according to the present invention is slidably incorporated on a guide pin fixed to the press housing. The important point here is that the guide pin extends vertically as does the direction in which the slide moves when driven by the rotation of the crank shaft. Thus, the present invention facilitates vertical balancing of the slide by moving the balancing weight in the vertical direction against the movement of the slide, thereby providing a stable movement.

The balancing device according to this invention is suitable for use in large high speed automatic presses, and the balancing performance thereof is far superior to that of the conventional art.

Another object of this invention is to obviate such provide a dynamic balancing device for a press which is simple in construction and which can effectively use the void space within the frame of a press by connecting the upper end of a connecting rod which connects an eccentric member of a crankshaft and a slide with a balancing weight by links and levers. This invention will now be described referring to embodiments shown in drawings.

Figure 1:
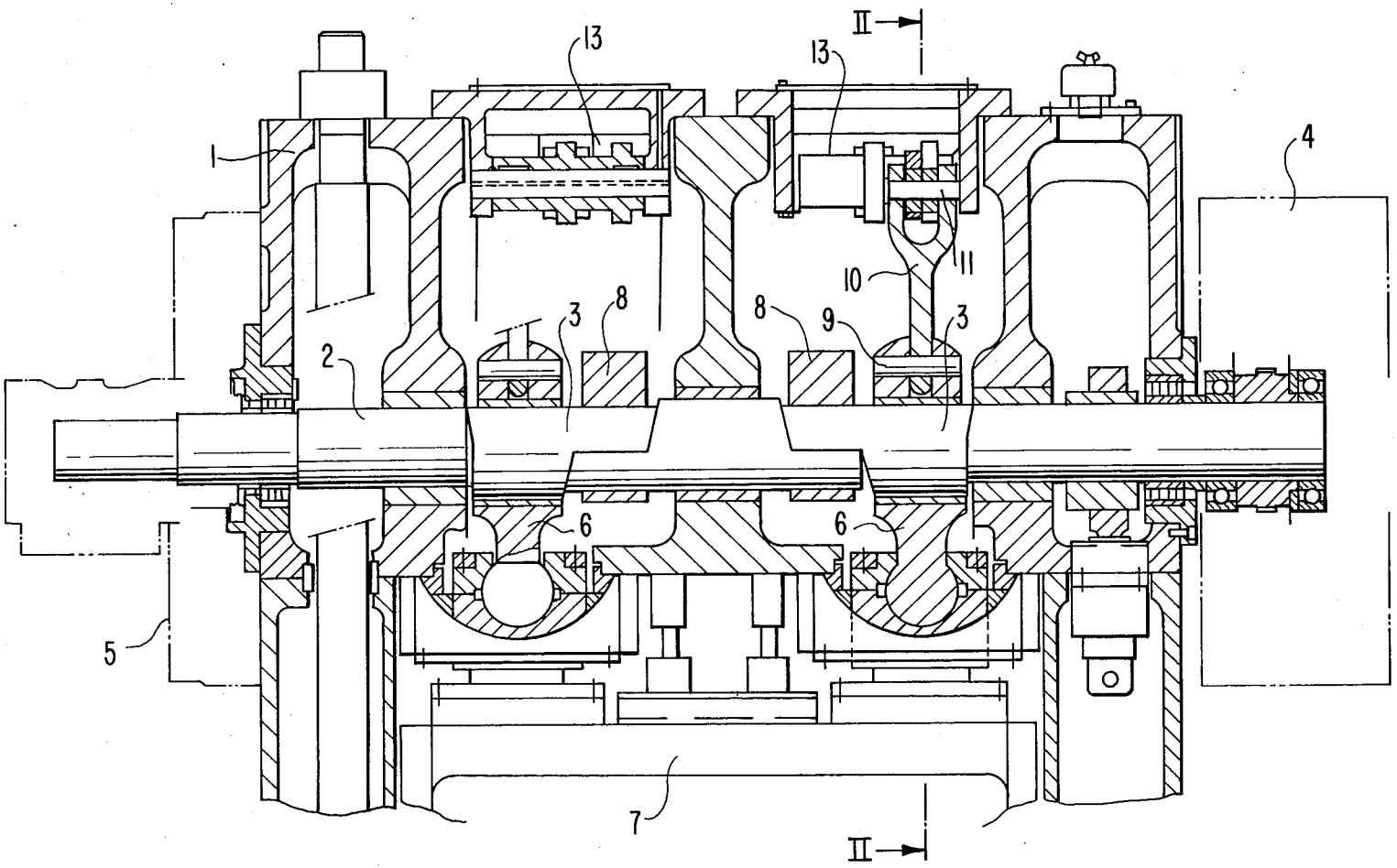
FIG. 1 is a front vertical sectional view of the essential portions of a press of which an embodiment of this invention is applied.

In FIG. 1, a crankshaft 2 is rotatably provided in a frame 1 of a press and eccentric members 3,3 are formed at two locations along the crankshaft 2. On one end of the crankshaft 2 is mounted a fly wheel 4 having a clutch. The rotation of the fly wheel 4 which is driven by a motor (not shown) is transmitted to the crankshaft 2 via the clutch. On the other end of the crankshaft 2 is provided a brake 5. Connecting rods 6,6, are engaged in a freely rotatable manner with the eccentric members 3,3 of the crankshaft 2 and have a large diameter on one end and spherical members on the other end connected to a slide 7 of the press. The crankshaft 2 is provided with balancing weights 8,8 which maintains a dynamic balance against the eccentric members 3,3.

Figure 2:
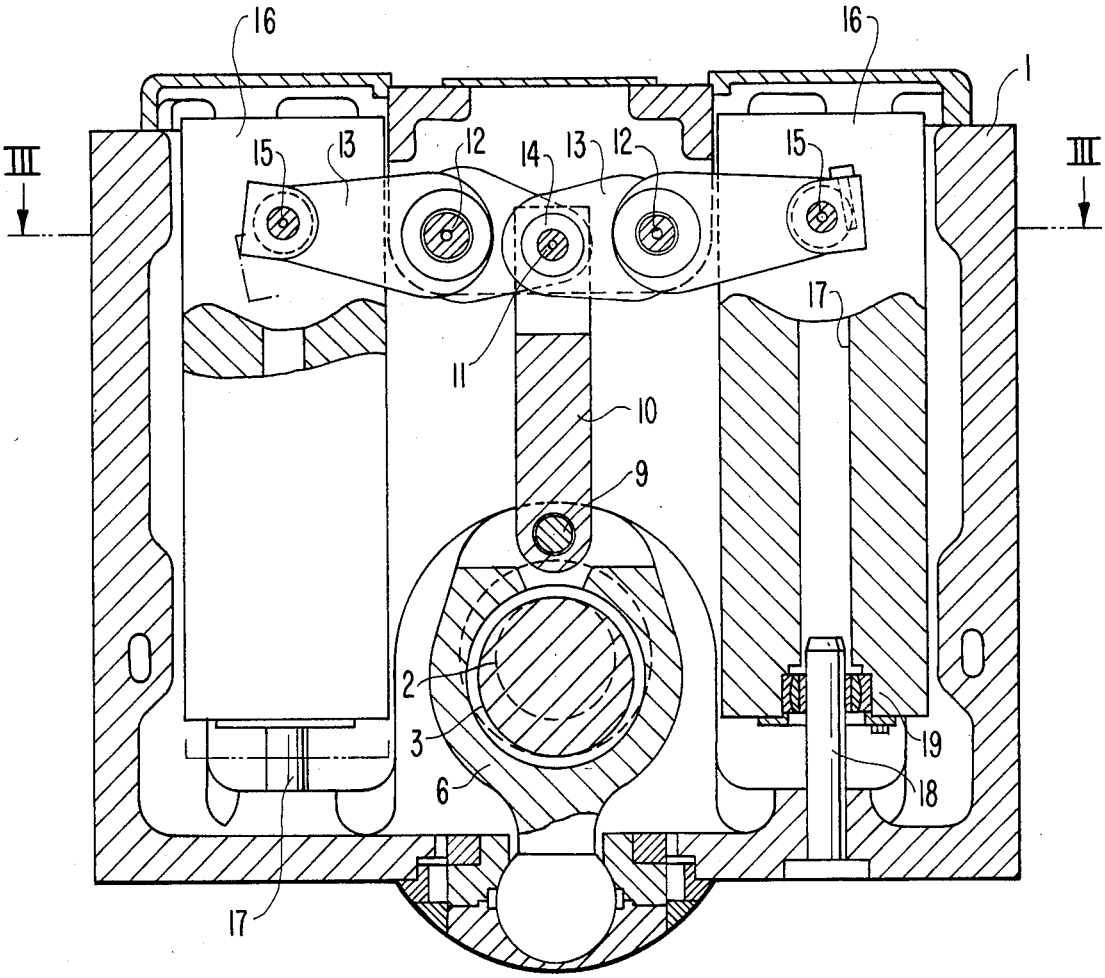
FIG. 2 is a sectional view taken along the line II—II of FIG. 1.
Figure 3:
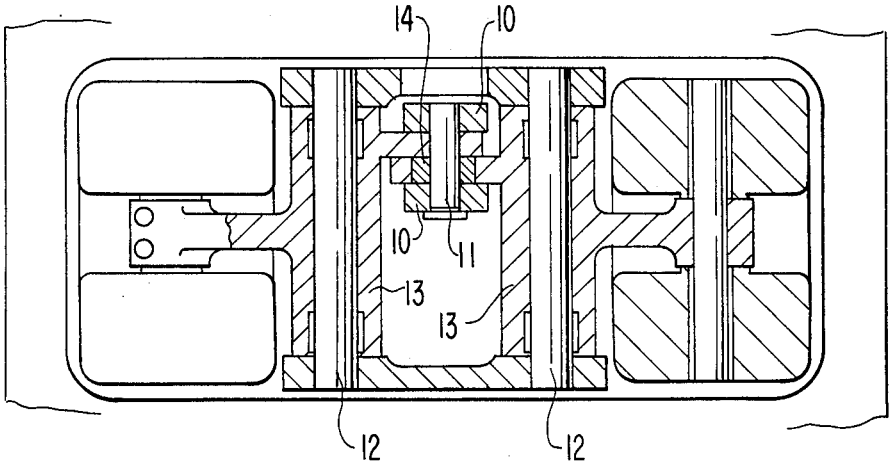
FIG. 3 is a sectional view taken along the line III—III in FIG. 2.

FIGS. 1, 2 and 3 show the structure having an embodiment of this invention wherein the head on a connecting rod of a larger diameter or the upper portion thereof is connected to a link 10 at the lower end thereof with a pin 9 parallel to the crankshaft 2. The upper end of a link 10 is forked in two.

A pair of levers 13,13 are journaled on the upper portion of the frame 1 with supporting axes 12,12 which are parallel to the crankshaft 2. The levers 13,13 are connected on one end thereof with the upper end of the link 10 with a pin 11. An eccentric bush 14 is interposed between the pin 11 and said one end of one of the levers 13 of said pair. This eccentric bush 14 is used to prevent the system comprising the links and levers which are connected by the pin 11 from being rocked.

In FIGS. 2 and 3, if attention is focused on the movement of the pin 11, the locus of the pin 11 forms an arc determined by an arm of the left side lever 13 and the right side lever becomes interlocked to the left side lever by the function of the eccentric bush 14. Therefore, an eccentric bush 14 may be provided respectively on both levers 13,13.

On the other end of each lever 13 is fixed respectively pins 15,15 which are parallel to the supporting axes 12. A pair of balance weights 16,16 are provided on both forward and rearward sides (or lefthand and righthand sides in FIG. 2) of the crankshaft 2, the balancing weights being connected to pin 15 of the lever 13 on the upper end thereof. Each of the balance weights 16,16 is bored to have a hole 17 extend vertically, through which is engaged a guide pin 18 fixed upward on the frame 1 in a manner to allow up and down movement of the weights via a ball joint 19. The above described structure is provided for each connecting rod 6,6, of the pair.

The operational effect will now be described. As the crankshaft 2 rotates, the slide 7 of the press is made to move vertically via the connecting rod 6. When the link 10 which is connected to the connecting rod 6 with a pin 9 moves up and down, the pin 11 moves in an arc around the supporting axis 12 of the lever 13 that the pin is directly connected to. The other lever 13 connected via the eccentric bush 14 follows the pin 11 to smoothly swing as the center distance between the eccentric bush 14 and the supporting axis 12 changes by the revolving movement of the eccentric bush 14 in arc around the pin 11. As the levers 13,13 swing in this manner, the pin 15 swings in an arc around the supporting axis 12. The balance weight 16 connected to the pin 15 follows the movement of the pin 15 to move up and down with its head swinging forward and rearward of the press as it is connected to the guide pin 18 via the ball joint 19. As the pair of balance weights 16,16 swing symmetrically in respect to the plane including the shaft center of the crankshaft 2, no vibration is caused in the horizontal direction. As is obvious from the foregoing description, according to this invention, as balance weights are connected to the larger diameter head portions of connecting rods via links and levers, the balancing structure becomes simplified and compact. Balance weights therefore may be provided which oppose the slide and one located in the space within the frame of a press, thereby enabling effective use of the space. This invention can achieve practical effect and merits as above mentioned.

What we claim is:

1. A dynamic balancing device in combination with a press having a rotating crank shaft with a crank rotated by said crank shaft and a reciprocating slide operatively connected to and driven by said crank, comprising:

a connecting rod means mounted around and freely rotatable relative to said crank and connected to said slide for reciprocating the slide along a path when said crank is rotated with said crank shaft;

link means directly pivotally connected at one end to said connecting rod means and reciprocated by said connecting rod means when said crank is rotated with said shaft;

a pair of levers pivotally connected to the other end of said link means at respective first ends thereof and extending in opposite directions from one another to respective second ends located at opposite sides of said crank shaft, each of said levers having a pivot point between said respective first and second ends around which said levers pivot;

a plurality of balancing weights for maintaining a dynamic balance of inertia forces generated by said slide and said connecting rod when said slide and connecting rod are reciprocated, a respective balancing weight connected at one end to the second end of a corresponding one of said pair of levers, said balancing weights being moved in opposite directions to said slide and connecting rod means by said pair of levers when said slide and connecting rod means are reciprocated, said balancing weights each having a bore extending from the other end therethrough in a direction parallel to the path along which said slide is reciprocated; and respective guide pins fixed to a frame of the press and each extending into a respective said bore of each of said balancing weights for slidingly guiding said balancing weights when said balancing weights are moved in the opposite directions.

2. The dynamic balancing device as claimed in claim 1 further comprising, a pin connecting said respective first ends of said pair of levers with said link means; and an eccentric bushing mounted to one of said pair of levers at said first ends between said pin and said first end of said one of said pair of levers.

3. The dynamic balancing device as claimed in claim 1 wherein, said balancing weights further comprise respective ball and socket joints in said bores slidably mounted to said guide pins.

* * * * *